US011346604B2

(12) United States Patent
Roberts et al.

(10) Patent No.: US 11,346,604 B2
(45) Date of Patent: May 31, 2022

(54) VEGETATION DRYING TRAY AND RACK SYSTEM

(71) Applicant: INTERMETRO INDUSTRIES CORPORATION, Wilkes-Barre, PA (US)

(72) Inventors: Carey Alan Roberts, Trucksville, PA (US); David A. Reppert, Kingston, PA (US); Jeffrey C. Olson, Dallas, PA (US); James Leo Kilgallon, Forty-Fort, PA (US); Timothy William Romantic, Drums, PA (US)

(73) Assignee: InterMetro Industries Corporation, Wilkes-Barre, PA (US)

( * ) Notice: Subject to any disclaimer, the term of this patent is extended or adjusted under 35 U.S.C. 154(b) by 51 days.

(21) Appl. No.: 16/848,070

(22) Filed: Apr. 14, 2020

(65) Prior Publication Data

US 2020/0340745 A1 Oct. 29, 2020

Related U.S. Application Data

(60) Provisional application No. 62/860,063, filed on Jun. 11, 2019, provisional application No. 62/837,257, filed on Apr. 23, 2019.

(51) Int. Cl.
*F26B 25/18* (2006.01)
*F26B 9/06* (2006.01)

(52) U.S. Cl.
CPC ..... *F26B 25/18* (2013.01); *F26B 9/066* (2013.01); *F26B 2200/02* (2013.01)

(58) Field of Classification Search
CPC ..... F26B 25/18; F26B 25/002; F26B 9/066; F26B 2200/02; F26B 3/06; F26B 19/005
USPC ..... 34/237, 238; 211/153, 151
See application file for complete search history.

(56) References Cited

U.S. PATENT DOCUMENTS

| | | | | |
|---|---|---|---|---|
| 486,137 | A | 11/1892 | Taylor | |
| 1,205,745 | A | 11/1916 | Jefferies | |
| 1,708,588 | A * | 4/1929 | Proctor | F26B 25/18 211/182 |
| 2,456,481 | A * | 12/1948 | Ballantyne | F26B 25/18 34/238 |
| 3,927,769 | A | 12/1975 | Maslow et al. | |
| 2012/0241349 | A1 * | 9/2012 | Koefelda | B65D 1/34 206/507 |

(Continued)

FOREIGN PATENT DOCUMENTS

| | | |
|---|---|---|
| CN | 207214675 U | 4/2018 |
| CN | 108195177 A | 6/2018 |

(Continued)

OTHER PUBLICATIONS

Extended European Search Report for EP201703071, conducted Aug. 20, 2020.

(Continued)

*Primary Examiner* — John P McCormack
(74) *Attorney, Agent, or Firm* — Harness, Dickey & Pierce, P.L.C.

(57) ABSTRACT

A vegetation tray includes a base. The base is formed from a thin wall having a plurality of spaced peaks and valleys. A plurality of apertures are in the base. The apertures enables passage of air for drying vegetation on the tray. A boundary wall extending from the base.

25 Claims, 6 Drawing Sheets

(56) References Cited

U.S. PATENT DOCUMENTS

| | | | | |
|---|---|---|---|---|
| 2016/0242384 | A1* | 8/2016 | Huntinghouse | A01K 1/0125 |
| 2021/0178398 | A1* | 6/2021 | Chiu | B01L 9/06 |

FOREIGN PATENT DOCUMENTS

| | | | |
|---|---|---|---|
| CN | 109595922 | A | 4/2019 |
| FR | 2226893 | A5 | 11/1974 |
| JP | 2995622 | B2 | 12/1999 |

OTHER PUBLICATIONS

VWR Spilltray and Drying Rack_product details, generated Oct. 19, 2020.

10 White Plastic Perforated Stackable Drying Trays for all Pasta Machines _ eBay, circa. Oct. 2020.

* cited by examiner

VEGETATION DRYING TRAY AND RACK SYSTEM

CROSS-REFERENCE TO RELATED APPLICATIONS

This application claims the benefit of U.S. Provisional Application No. 62/860,063, filed on Jul. 11, 2019 and U.S. Provisional Application No. 62/837,257, filed Apr. 23, 2019. The entire disclosures of the above applications are incorporated herein by reference.

FIELD

The present disclosure relates to a vegetation drying tray and rack system.

BACKGROUND

This section provides background information related to the present disclosure which is not necessarily prior art.

Known vegetation drying apparatus include planar sheet pans having perforations in the flat (i.e., horizontally planar) bottom surface of the pan. While the perforations enable air flow through the bottom of the pan, such apparatus result in a not insignificant amount of contact between the surface of the pan (e.g., the flat bottom surface) and the vegetation to be dried. FIG. 2A schematically illustrates this issue.

The undesirable result is that there is an increased opportunity for portion(s) of the vegetation to be dried to be inhibited from direct contact with the air and/or flow of air cross its surface. As such, the time required for the sufficient or desired amount of moisture to be removed from the vegetation (i.e., the drying time) is not optimal. Further, such a condition presents a risk of contamination of the vegetation due to the development of mold, mildew or other microorganism(s) and/or infestation of pests in, on or around the vegetation.

SUMMARY

The present disclosure provides a vegetation drying tray and rack system which improves the process for drying various forms of vegetation. The vegetation drying tray and rack system can improve drying performance by reducing the drying time needed for the vegetation to be thoroughly dried and by reducing the risk of contamination of the vegetation originating or spreading during the drying process.

The vegetation drying tray and rack system increases ventilation and air flow in and around the vegetation to be dried while simultaneously reducing and/or minimizing the physical contact between surfaces of the drying tray and the vegetation to be dried.

The vegetation drying tray and rack system can incorporate an identification feature in the form of an identifier plaque or plate that can serve as a visual indicator to users of the system. For example, the plaque can communicate to and/or assist users to quickly identify a status of the vegetation, a vegetation drying tray and/or the rack system without input from the user. Such status or conditions can include whether the vegetation drying tray(s) has been rotated or inverted; the drying state of the vegetation in the system like in process, complete, partially-rotated, or fully-rotated. In this regard, the plaques can enable a quick identification through one or more visual indicator(s) or cue(s) including color, orientation, physical configuration and/or other identifier(s) corresponding to or indicating one or more states or conditions. The plaques/plates can change state when the drying trays are manipulated (such as rotated or inverted) during the vegetation drying operation.

The plaques or plates can be removably joined or attached to the drying trays. For example, the drying trays can include one or more receptacles at locations around the perimeter of the drying tray and include vertical slots or openings in the receptacles. The receptacles can be integrated with or form a portion of the upper lip or rim of one or more side walls of the drying trays. For example, a slot can be included in the receptacle through an upper surface of the rim. The slot can accommodate insertion of a plaque such that one portion of the plaque is received in the slot and another portion of the plaque extends out of the slot and above the surface of the rim of the side wall. In addition, the receptacle can include an opposing slot at a lower end or underside of the receptacle.

Further, the plaques or plates can facilitate the vertical stacking or connecting of drying trays in the same orientation or in an inverted orientation. The plaques can stay in the drying trays when not in use and help prevent trays from toppling over while they are in storage.

The vegetation drying tray and rack system is conducive to and enables the vegetation to be readily inspected throughout the drying process.

The vegetation drying tray and rack system can incorporate and provide access controls which limit unauthorized personnel from gaining access to or coming into contact with the vegetation during the drying process or provide other security measures. For example, physical and/or electronic barriers, locking device(s), alarm(s) and the like can be implemented vegetation drying tray and rack system.

The vegetation drying tray of the present disclosure can be manufactured from plastic as an alternative to stainless steel or aluminum from which known drying trays are made. Moreover, the vegetation drying tray of the present disclosure can include or incorporate an anti-microbial additive and/or coating (such as Microban™) for aiding in reducing a potential for the occurrence and/or spread of contaminants in and around the drying try and vegetation, such as molds or funguses.

The vegetation drying tray can be retrofit and/or used with other existing rack systems.

According to one aspect of the disclosure, a vegetation tray comprises a base formed from a thin wall. The base has a plurality of spaced peaks and valleys. A plurality of apertures are formed in the base. The apertures enable passage of air to drying vegetation on the tray. A boundary wall extends from the base. The boundary wall includes one or more apertures. An indexing member, including a projection or recess, extends from the boundary wall. The indexing member mate with respective tray indexing members to enable stacking and inversion of the trays. The peaks and valleys are spaced from one another with a distance between peak axes from ¼ to 3 inches. An identification feature communicates the status of the tray to the user. The identification feature comprises a plate including one or more visual indications including at least one of color orientation or physical configuration indicating the status. A receptacle on the boundary wall receives the identification feature communicating status of the tray. A plurality of trays are stackable one on top of the other with adjacent trays nesting with one another. The trays may further include an anti-fungal additive. A tray verification member is on the boundary wall. The verification member may include indicia for providing the status of the vegetation in the tray. The indicia may include symbols, writings, color, cutouts, plaques or the like. The boundary wall includes one more triangular channels. Each channel includes opposing sidewalls and a web connecting the sidewalls. The web includes an aperture.

According to a second aspect of the disclosure, a vegetation drying rack system comprises a frame. The frame has one or more tray receiving receptacles on the frame. The frame includes one or more trays. The tray has a thin wall base. The base has a plurality of spaced peaks and valleys. A plurality of apertures are formed in the base. The apertures enable passage of air to dry vegetation on the tray. A boundary wall extends from the base. The boundary wall includes one or more apertures. An indexing member, including a projection or recess, extends from the boundary wall. The indexing member mate with respective tray indexing members to enable stacking and inversion of the trays. The peaks and valleys are spaced from one another with a distance between peak axes from ¼ to 3 inches. An identification feature communicates the status of the tray to the user. The identification feature comprises a plate including one or more visual indications including at least one of color orientation or physical configuration indicating the status. A receptacle on the boundary wall receives the identification feature communicating status of the tray. A plurality of trays are stackable one on top of the other with adjacent trays with one another. The trays may further include an anti-fungal additive. A tray verification member is on the boundary wall. The verification member may include indicia for providing the status of the vegetation in the tray. The indicia may include symbols, writings, color, cutouts, plaques or the like. The boundary wall includes one more triangular channels. Each channel includes opposing sidewalls and a web connecting the sidewalls. The web includes an aperture.

A further aspect of the disclosure, a vegetation tray comprises a base formed from a thin wall. The base has a configuration devoid of flat sections. The boundary wall includes one or more apertures. The base provides line or point contact with the vegetation on the base. The base includes a plurality of peaks and valleys.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIGS. 9(*a*)-(*c*) are perspective views of trays with vegetation with the tray being inverted;

FIGS. 10(*a*)-(*c*) are perspective views in racks with various position of trays; and FIGS. 11(*a*)-(*e*) are cross-section views of various tray configuration.

Figure 12:
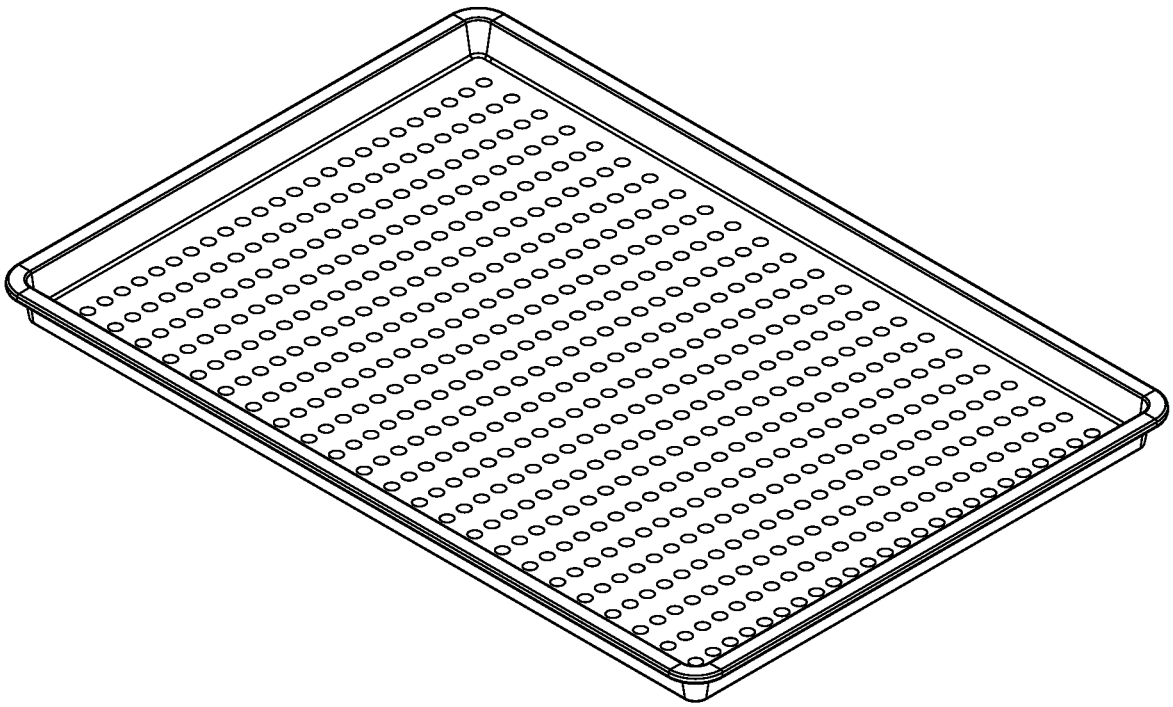
FIG - 12 Prior Art

FIG. 12 is a perspective view of a prior art tray.

Corresponding reference numerals indicate corresponding parts throughout the several views of the drawings.

DETAILED DESCRIPTION

Example embodiments will now be described more fully with reference to the accompanying drawings.

FIG. 12 illustrates a prior art tray. Here, the base is flat (i.e., horizontal) or planar and includes perforations. Thus, the vegetation is subjected to be positioned on the flat surface entirely in contact with a planar surface of the base. Also, the airflow, at best, at the vegetation is on its top surface and below the surface of the tray base.

Turning to the figures, a vegetation tray is illustrated and designated with the reference numeral 20. The tray includes a base 22 and a boundary wall 24 with a projecting lip 26. The trays 20 are dimensioned to fit into conventional racks 30. The racks 30 include a frame 32 as well as tray support or guides 34. Thus, the trays 20 nest in a receptacle and can be slid in and out of the rack 30. The rack 30 may also have wheels 36 enabling movement of the rack 30 in the drying facility.

The base 22 is defined from a thin wall 28. The wall 28 has a configuration with one or more peaks 40 and valleys 42 within the boundary wall 24. Additionally, the thin wall 28 includes a plurality of apertures 44. The peaks 40 and valleys 42 may be in a random or continuous pattern across the base 22. The peaks 40 and valleys 42 provide a line or point contact with the vegetation 25. The wall configuration eliminates the entire planar contact of the vegetation with the planar surface as illustrated in the prior art.

Figure 1:
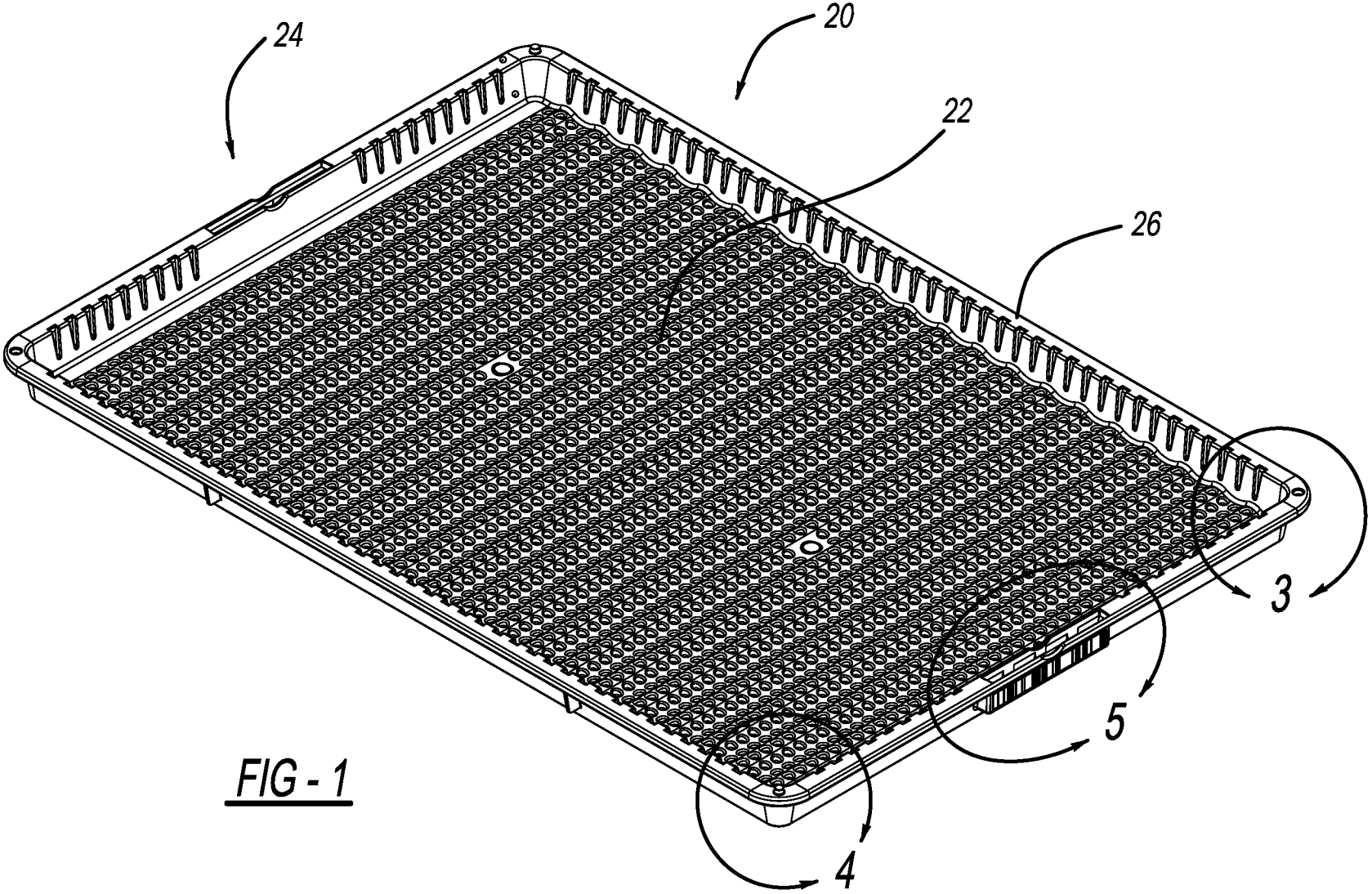
FIG. 1 is a perspective view of the vegetation tray.
Figure 2:
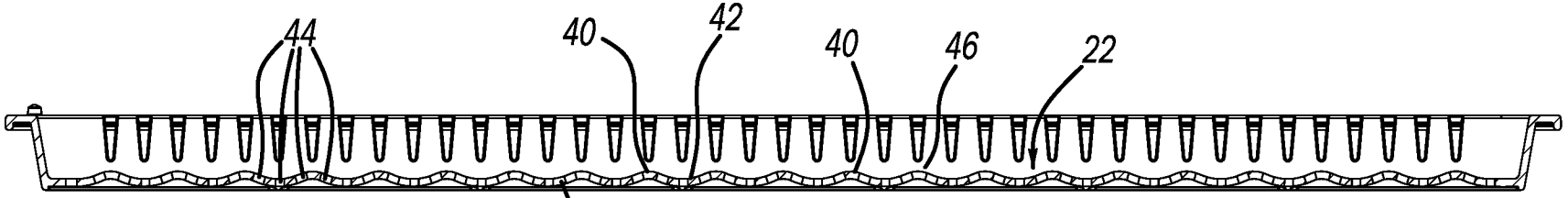
FIG. 2 is a longitudinal cross-section of FIG. 1.
Figure 4:
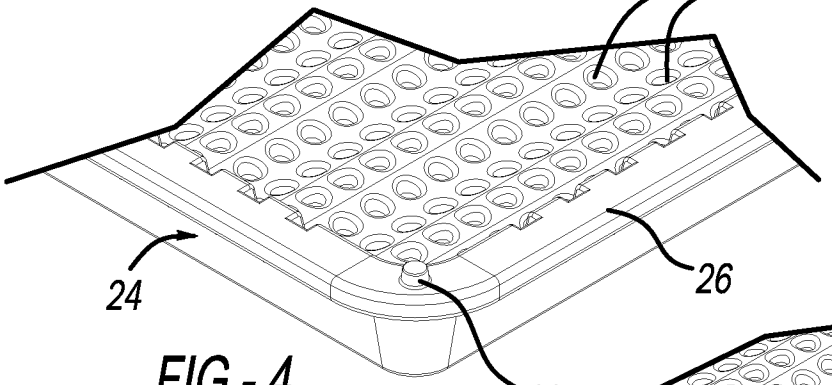
FIG. 4 is a partial enlarged perspective view of FIG. 1 (Circle 4)
Figure 5:
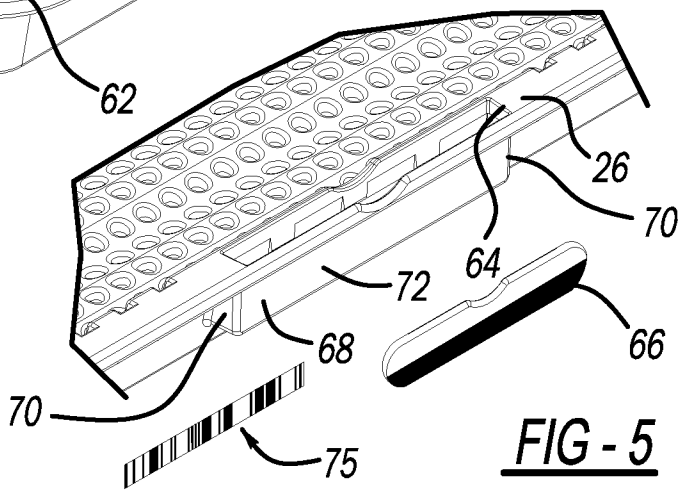
FIG. 5 is a partial enlarged exploded perspective view of FIG. 1 (Circle 5)
Figure 3:
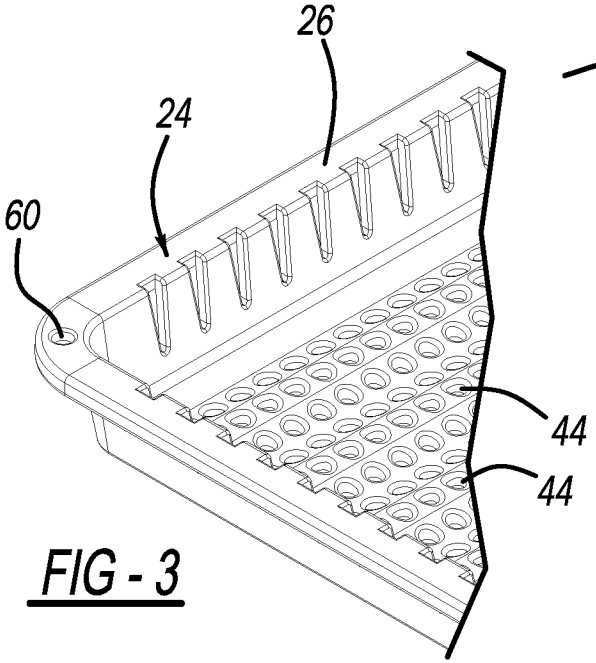
FIG. 3 is a partial enlarged perspective view of FIG. 1 (Circle 3)
Figure 6:
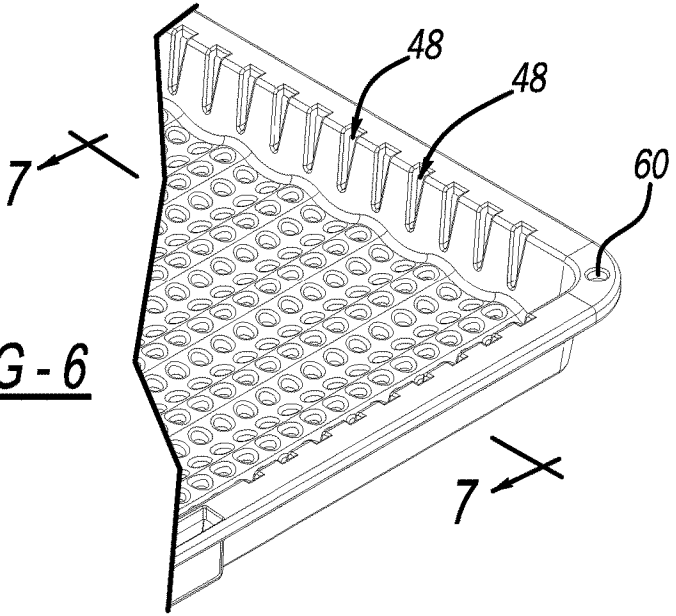
FIG. 6 is a partial enlarged perspective of FIG. 1 toward the sidewall.
Figure 7:
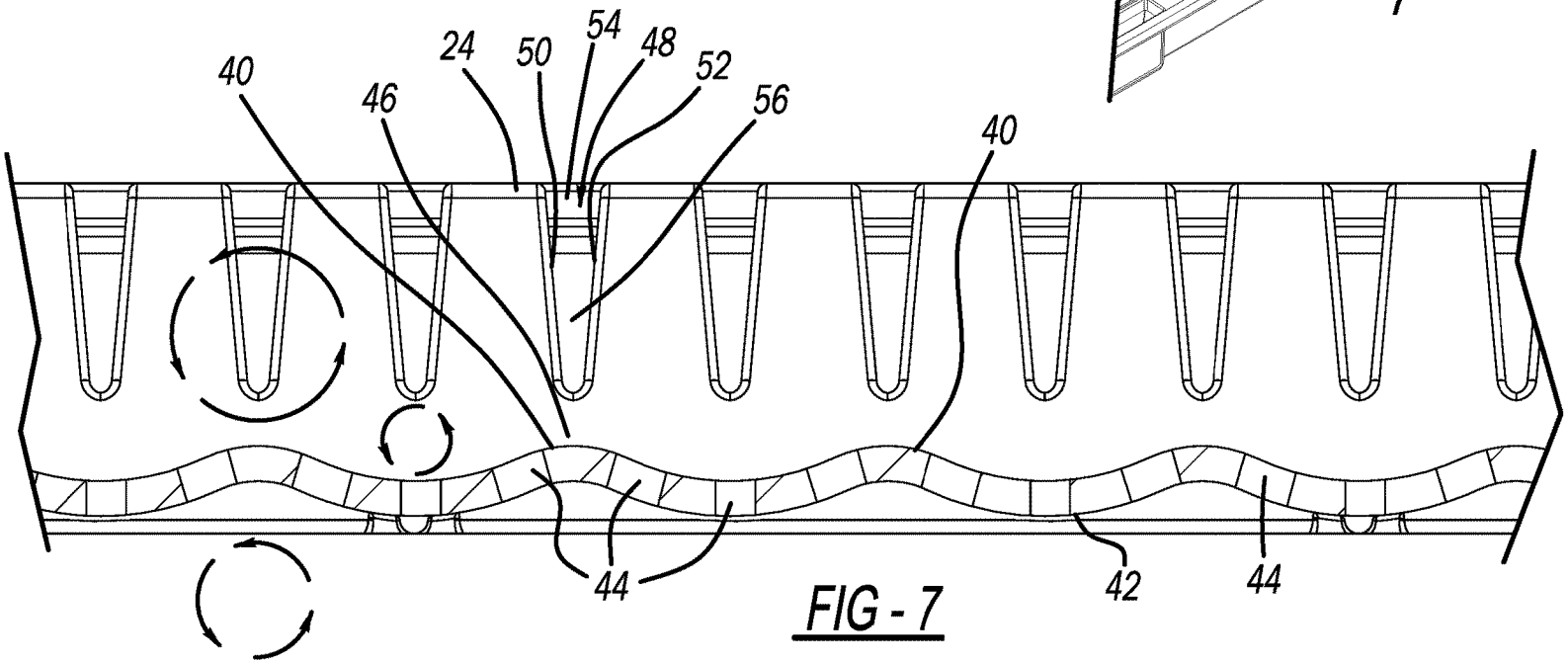
FIG. 7 is a cross-section of FIG. 6 along line 7-7.

The apexes 46 of the peaks 40 are generally positioned at a desired distance with respect to one another. The distance is generally between ¼ to 3 inches inches. Preferably, a spacing of ¼ to 2 inches is preferred. The peak 40 and valley 42 configuration enables airflow to flow under the peaks 40 and valleys 42 as well as on top of the peaks 40 and valleys 42. Additionally, airflow is created between the peaks 40 and valleys 42 inside the tray underneath the vegetation as illustrated in FIG. 7. Thus, the peak 40 and valley 42 configuration creates more airflow than the prior art trays.

The boundary wall 24 surrounds the base 22. The boundary wall 24 includes one or more channels 48 formed in the wall. The channels, having a triangular configuration, are defined by opposing sidewalls 50, 52 and web 54. The web 54 connects the sidewalls 50, 52 with one another. An aperture 56 is formed in the web 54. The aperture 56 enables air to pass through the boundary wall 24. Thus, airflow can enter the tray 20 via the boundary wall 24, base 22 or in the opening between the boundary wall 24. The channel configuration provides for single direction molding of the tray 20. This eliminates the need for two directional molding. Thus, the tray is able to be formed on a single direction two-piece mold.

The lip 26 projects from the boundary wall 24. The lip 26 provides a surface substantially perpendicular to the boundary wall 24. This enables various features to be added to the tray 20. The lip 26 includes a recess 60 and a projection 62. The recess 60 and projection 62 act as an indexing mechanism to enable the trays to be stacked and inverted with one another. The recess 60 and projection 62 enable trays 20 to be positioned one on top of the other. The lips are positioned.

Figure 8:
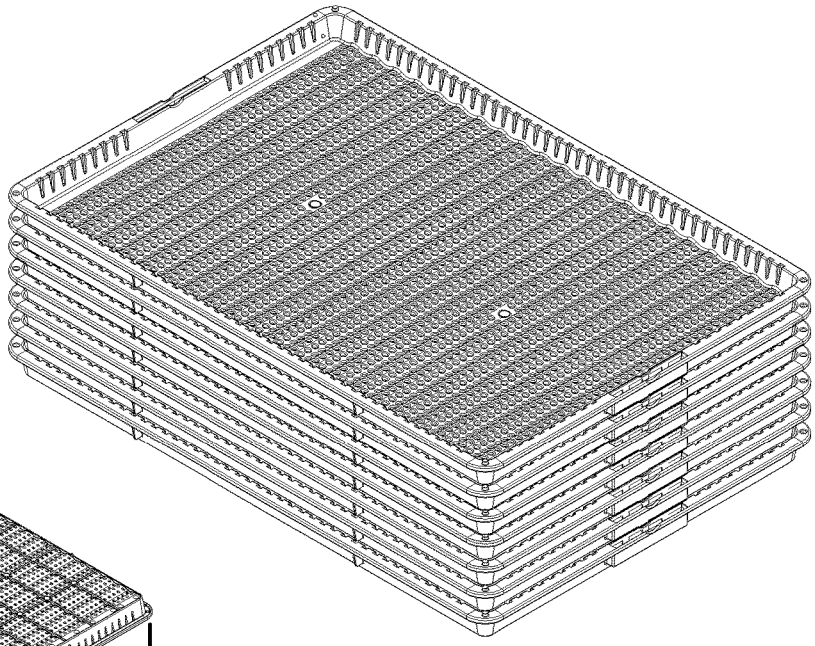
FIG. 8 is a perspective view of the trays stacked.
Figure 9A:
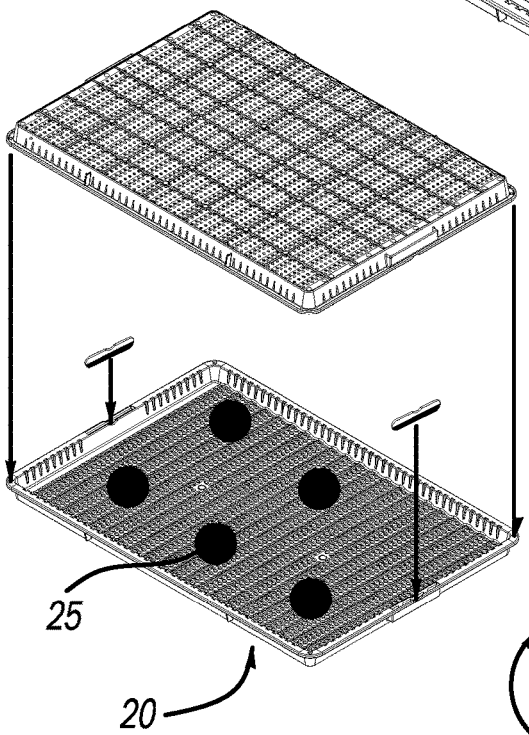
Figure 9B:
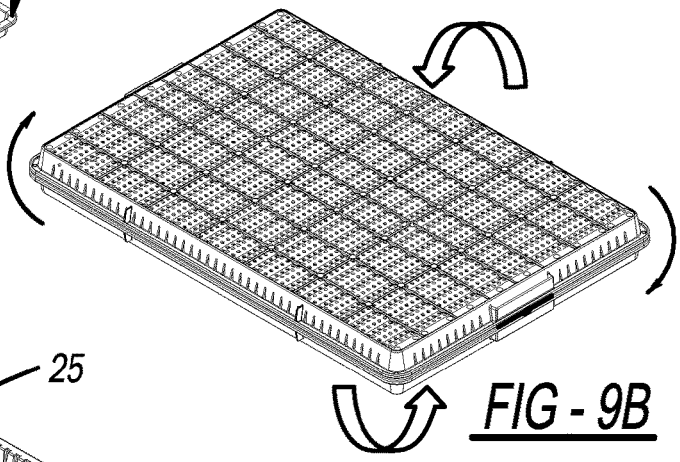
Figure 9C:
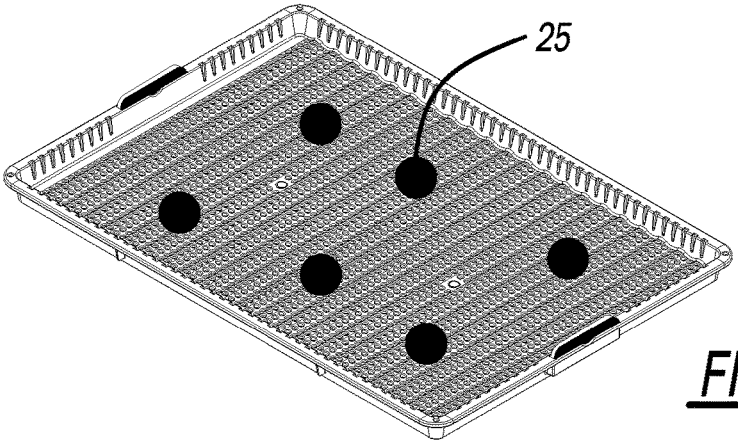

When stacked (FIG. 8), the projections 62 insert into the hollow void of the adjacent projection 62 one on top of the other. When inverted, the projection 62 extends into the recess 60, as seen in FIG. 9A-9C, to enable the rotation and inversion of the vegetation 25 within the tray 20. The recesses 60 are positioned at diagonal corners on the tray 20. Likewise, the projections 62 are positioned in the opposite diagonal corners of the tray 20. The inverting of the tray will be discussed later.

The lip 26 includes a receptacle 64 to receive a plaque 66. The plaque 66 that can be positioned within the receptacle 64 to determine the phase of the drying process of the vegetation 25. The receptacle 64 is a slot formed in the lip 26. The receptacle 64 is generally rectangular having an outer wall 68 and sidewalls 70. The plaque 66 is sized so that it is maintained within the receptacle 64. However, upon flipping or rotating of the tray 20, via gravity, the plaque 66 falls from one tray receptacle 64 to the other depending upon which tray is under or on the bottom of the other. Thus, the plaque 66 could be color coded or have different type of indicia to indicate to the user, the drying phase of the vegetation.

The outer wall 68 provides a generally planar surface 72. This planar surface 72 can be utilized to receive a bar code sticker 75 or the like indicia to provide verification of the vegetation 25 within the tray 20. Some jurisdictions require that the vegetation 25 in the tray 22 be accounted for from seed to sale. Thus, the vegetation 25 must be verified or tracked from point to point to point along the growing and processing stages until the vegetation is sold. Accordingly, the outer wall 68 surface 72 can receive various labels to verify or identify the vegetation 25.

The tray 20 is generally formed from plastic during an injection molding process. As explained above, the boundary wall 24 enables a single direction mold be utilized to form the tray 20. Thus, the tray 20 is a one piece design. The tray 20 could be formed with an antimicrobial additive such as Microban. This provides for reducing spreading of any fungus or the like that might be on the vegetation placed within the tray 20. Also, while the peaks and valleys shown are of a sinusoidal configuration in cross-section. FIGS. 11A-11E illustrate various configurations. A step wave type of configuration could be utilized. Additionally tetrahydron configuration could be used to provide the peaks and valleys. Thus, any configuration that provides peak and valley and eliminate entire flat (i.e., horizontally planar) sections on the base could be utilized for the wall of the tray 20.

Figures 10A, 10B, 10C:
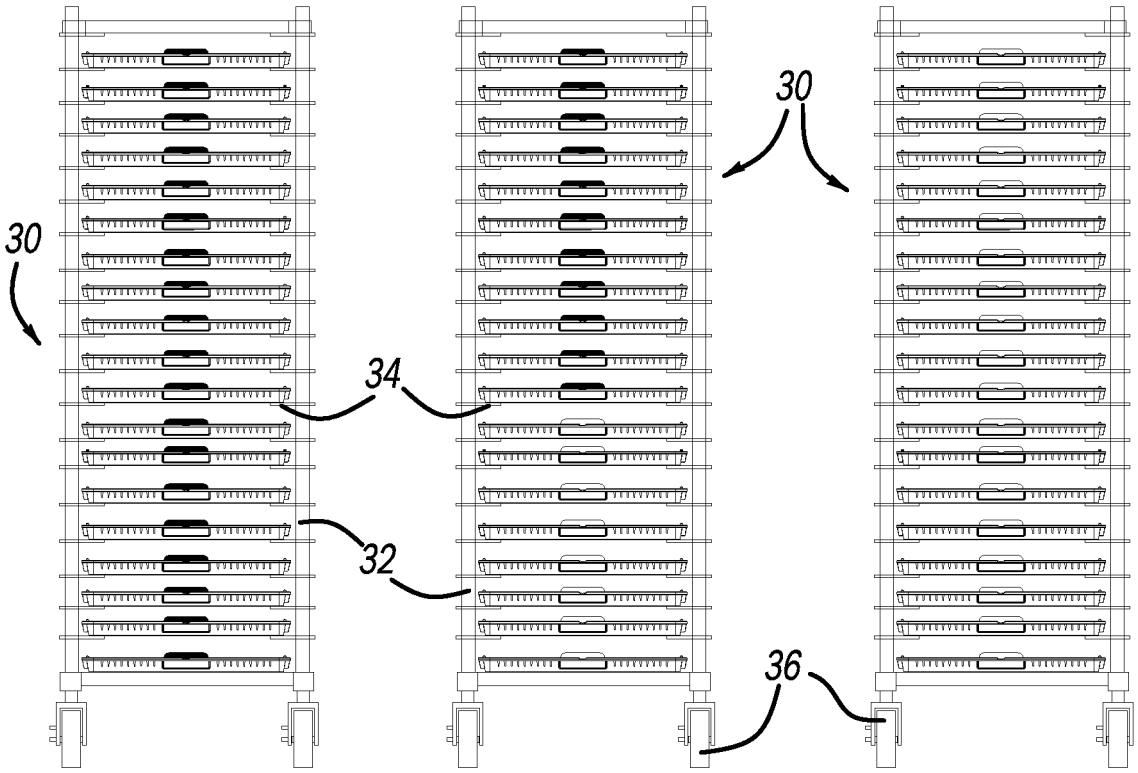
Figure 11A:
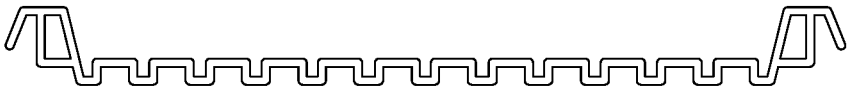
Figure 11B:
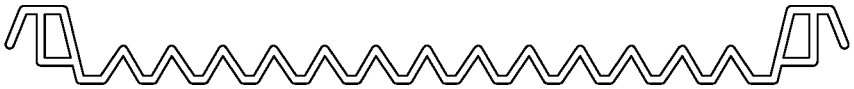
Figure 11C:
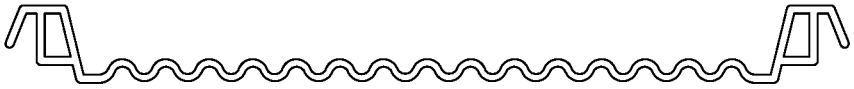
Figure 11D:
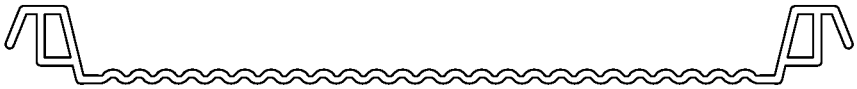
Figure 11E:
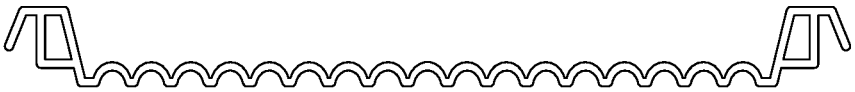

Trays 20 are illustrated positioned on shelves or guides 34 in a rack 30. As can be seen, the plaques 66 all identified the same drying status of the vegetation. Thus, as illustrated, a darker color is illustrated in FIGS. 5-10A. In FIG. 10B, a partial number of all the trays have been inverted and the rack 30 includes half dark colored plaques 66 and half-light colored plaques 66. FIG. 10C illustrates the complete inversion or rotation of all of the trays such that the plaques 66 are all of a light color. Thus, the use of the tray 20 and rack 30 system will always identify the drying status of the degradation in the particular trays.

In order to rotate, invert or flip the trays 20, the tray including the vegetation 25 would be removed from the rack 30. A second tray 20 illustrated in FIG. 9B would be invertly positioned on top of the first tray 20 so the lip indexing mechanism would have the recesses 60 filled with the projections 62. This enables the user to rapidly rotate, invert or flip the vegetation within the trays 20. After rotation, inversion or flipping, the once bottom tray, now top tray, would be removed. This tray would be processed for cleaning or the like. The new tray 20 with vegetation can be positioned back into the rack 30 so that its new drying status of the vegetation is known. Thus, the tray 20 enables for rapid turning and manipulation of the vegetation within the tray to enhance drying. Thus, the drying time of the vegetation can be reduced and more thorough drying can take place in the trays.

Also, in addition to the plaque 66, the trays themselves could be of different colors. Thus, a green tray could indicate a first state of drying and a red tray could indicate a second state of drying. Also, symbols, writings, cutouts could be utilized to designate the status of the drying of the vegetation within the tray.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A vegetation tray comprising:

a base, the base formed from a thin wall having a plurality of spaced peaks and valleys;

a plurality of apertures in the base, the apertures being disposed along the peaks and valleys and the apertures enabling passage of air for drying vegetation on the tray; and a boundary wall extending from and surrounding the base, a distal end of the boundary wall defining an open end of the vegetation tray;

a lip comprising a substantially planar surface and projecting substantially perpendicularly from the distal end of the boundary wall;

an indexing member disposed on the lip and configured to receive a second vegetation tray in an inverted orientation relative to the vegetation tray, and in a stacked arrangement upon the vegetation tray such that the lip of the vegetation tray and a second lip of the second vegetation tray are positioned next to one another.

2. The vegetation tray of claim 1, further comprising a plurality of apertures in the boundary wall.

3. The vegetation tray of claim 1, wherein the indexing member includes a projection or recess for mating with a respective indexing member of the second vegetation tray for enabling the inverted and stacked arrangement of the second vegetation tray upon the vegetation tray.

4. The vegetation tray of claim 1, wherein the peaks are spaced from one another with a distance between apexes being from ¼ to 3 inches.

5. The vegetation tray of claim 1, further comprising an identification feature communicating a status of the vegetation tray.

6. The vegetation tray of claim 5, wherein the identification feature comprises a plaque including one or more visual indications including at least one of color orientation or physical configuration indicating the status.

7. The vegetation tray of claim 1, further comprising a receptacle on the lip for receiving an identification feature communicating status of the vegetation tray.

8. A vegetation drying rack system comprising:

a frame, one or more tray receiving receptacles on the frame; and one or more vegetation trays according to claim 1.

9. A method of drying vegetation comprising:

providing a rack including a plurality of tray receiving receptacles;

providing an equal plurality of trays according to claim 1 in the plurality of tray receiving receptacles;

placing vegetation on the plurality of trays;

removing the plurality of trays from the rack;

manipulating the plurality of trays;

reorganizing the vegetation by the manipulations to enhance drying of the vegetation.

10. The method of claim 9, further comprising identifying a status of the vegetation in the plurality of trays positioned on the rack.

11. The method of claim 10, further identifying the status of the plurality of trays after the step of manipulating the plurality of trays.

12. The method of claim 9, wherein the step of manipulating the plurality of trays further comprises rotating, inverting or shifting the plurality of trays.

13. The method of claim 12, wherein during inverting, positioning a like tray lip to lip and moving the vegetation from one tray to the like tray.

14. The vegetation tray of claim 1, wherein a plurality of trays are stackable one on top of another with adjacent bases nesting with one another.

15. The vegetation tray of claim 1, further comprising an antimicrobial additive associated with the vegetation tray.

16. The vegetation tray of claim 1, further comprising a vegetation verification member on the boundary wall.

17. The vegetation tray of claim 1, wherein the vegetation tray includes indicia for providing a status of the tray to a user.

18. The vegetation tray of claim 17, wherein the indicia may include symbols, writings, color, cutouts, or plaques.

19. The vegetation tray of claim 1, wherein the boundary wall includes one or more channels, each channel including opposing sidewalls and a web connecting the sidewalls.

20. The vegetation tray of claim 19, wherein the web includes an aperture.

21. The vegetation tray of claim 19, wherein the one or more channels has a triangular configuration.

22. A vegetation tray comprising:

a base, the base formed from a thin wall, the base having a configuration devoid of horizontally planar sections;

a plurality of apertures in the base, the apertures being continuous along a plurality of peaks and valleys in the base and the apertures enabling passage of air for drying vegetation on the vegetation tray; and a boundary wall extending from the base, a lip projecting from an extending end of the boundary wall wherein an additional like vegetation tray can be stacked on the vegetation tray in an inverted orientation relative to the vegetation tray such that the respective lips of the vegetation tray and the like vegetation tray are positioned next to one another.

23. The vegetation tray of claim 22, wherein the base provides line or point contact with vegetation on the base.

24. The tray of claim 22, wherein the base includes a plurality of peaks and valleys.

25. The vegetation tray of claim 22, further comprising a receptacle on the lip for receiving an identification feature communicating a status of the vegetation tray.

* * * * *